US011603283B2

(12) United States Patent
Kim

(10) Patent No.: US 11,603,283 B2
(45) Date of Patent: Mar. 14, 2023

(54) APPARATUS FOR TIGHTENING WIRE

(71) Applicant: Jin Ho Kim, Incheon (KR)

(72) Inventor: Jin Ho Kim, Incheon (KR)

(73) Assignee: Jin Ho Kim, Incheon (KR)

( * ) Notice: Subject to any disclaimer, the term of this patent is extended or adjusted under 35 U.S.C. 154(b) by 415 days.

(21) Appl. No.: 16/852,689

(22) Filed: Apr. 20, 2020

(65) Prior Publication Data

US 2021/0269275 A1 Sep. 2, 2021

(30) Foreign Application Priority Data

Feb. 28, 2020 (KR) ..... 10-2020-0025099
Mar. 18, 2020 (KR) ..... 10-2020-0032986

(51) Int. Cl.
*A43C 11/16* (2006.01)
*B65H 54/02* (2006.01)
*B65H 59/00* (2006.01)

(52) U.S. Cl.
CPC ..... *B65H 54/02* (2013.01); *A43C 11/165* (2013.01); *B65H 59/00* (2013.01); *Y10T 24/2187* (2015.01); *Y10T 24/3724* (2015.01)

(58) Field of Classification Search
CPC ..... Y10T 24/3724; Y10T 24/2187; Y10T 24/2183; A43C 11/165; B65D 54/02; B65H 59/00
See application file for complete search history.

(56) References Cited

U.S. PATENT DOCUMENTS

2017/0303643 A1* 10/2017 Converse ..... A61C 7/026
2020/0346888 A1* 11/2020 Kruse ..... F16G 11/12
2021/0186160 A1* 6/2021 Chen ..... A43C 11/20

FOREIGN PATENT DOCUMENTS

KR 1954753 B1 * 3/2019 ..... A43C 11/14

OTHER PUBLICATIONS

Translation of 101954753 generated at engportal.kipris.or.kr (Year: 2022).*

* cited by examiner

*Primary Examiner* — Robert Sandy
*Assistant Examiner* — Michael S Lee

(57) ABSTRACT

Provided is an apparatus for tightening wire, including: a housing (10); a spool (20) mounted to the housing to wind a wire; a winder (30) that engages with the spool to wind the wire or disengages from the same to unwind the wire; a ratchet (40) that allows axial rotation in one direction in which the wire is tightened; a spiral cam (50) where the winder and the ratchet are mounted; and a dial (60) mounted to the spiral cam to axially rotate the winder. The apparatus provides an engagement and disengagement structure that allows the spool and the winder to engage or disengage, so that, by forward and backward rotations, only the wire is wound when the spool and the winder engage and the wire is unwound when the spool and the winder disengage, thereby allowing the winding and unwinding of the wire by simple forward and backward rotating operation.

6 Claims, 9 Drawing Sheets

APPARATUS FOR TIGHTENING WIRE

BACKGROUND

Field

Embodiments of the present invention relate to an apparatus for tightening wire, and more particularly, to an apparatus for tightening wire, which comprises: a spool for winding a wire; a winder that engages with or disengages from the spool; a dial for axially rotating the winder; a ratchet for axially rotating the dial in only one direction in which the wire is tightened, and an engagement and disengagement structure that allows the spool and the winder to engage or disengage, so that, through the forward and backward rotation using the engagement and disengagement structure, only the wire is wound when the spool and the winder engage and the wire is unwound when the spool and the winder disengage.

Related Art

Normally, the strings (wire) of a shoe are tied by the wearer themselves. Tying the shoe strings with hands will cause inconvenience in any form, and, in this regard, a variety of reel systems have been proposed recently so that strings are tied by dialing.

In an example, a reel system according to the conventional art will be schematically described below. The reel system according to the conventional art comprises a housing, a spool supported by the housing, and a reel supported by the housing. They are assembled with fasteners, such as small screws, and the reel is configured in such a way that collects a cable at a channel formed in the spool when the spool rotates in a first direction relative to the housing, and that get the cable out of the spool when the spool rotates in a second direction relative to the housing.

However, such a reel system according to the conventional art works by rotating the cable in the first direction when tightening it and rotating the cable in the second direction when releasing it, which requires rotating the spool even when releasing the cable, and, at the same time, involves the risk that the cable might be released by external force because the spool also rotates in the direction the cable is released.

Moreover, the entire handle has to be lifted up in order to release the cable from the spool, and the entire handle has to be pressed in order to wind it up.

In addition, another conventional technique was employed—that is, a button method in which, when a button is pressed to engage a winder and a spool, they rotate axially as a single unit to wind the wire, and when the button is pressed again to disengage the winder and the spool, only the spool rotates axially to unwind the wire.

However, this conventional technique has problems, such as taking up a large volume because the button protrudes upward and easily causing damage or breakage to the button due to external impact or the like, making the reel system unusable.

SUMMARY

Embodiments of the present invention have been devised to address these problems and provide an apparatus for tightening wire, that allows the winding and unwinding of wire by simple forward and backward rotating operation, by comprising: a spool for winding a wire; a winder that engages with or disengages from the spool; a dial for axially rotating the winder; a ratchet for axially rotating the dial in only one direction in which the wire is tightened, and an engagement and disengagement structure that allows the spool and the winder to engage or disengage, so that, through the forward and backward rotation using the engagement and disengagement structure, only the wire is wound when the spool and the winder engage and the wire is unwound when the spool and the winder disengage.

An exemplary embodiment of the present invention provides an apparatus for tightening wire, the apparatus comprising: a housing comprising a bottom, a plurality of gates extending upward from the bottom and penetrating the inside and outside of the outer periphery, and an enclosure with unidirectional projections formed along the inner periphery; a spool comprising upper and lower plates fixed to the bottom of the housing, down below the unidirectional projections, surrounded by the enclosure, and vertically separated from each other, communicating holes with a small diameter formed between the upper and lower plates, for communicating with the plurality of gates, a winding portion to which two ends of a wire guided inside through the communicating holes are fixed, for winding the wire around the outer periphery, and a plurality of winding projections formed on top of the upper plate; a winder comprising axial rotating projections placed above the spool, for disengaging from and engaging with the winding projections of the spool when moved up and down, and a plurality of camshafts protruding radially on the edge; a ratchet comprising an up-and-movement guide provided on one side of the outer periphery surrounding the exterior of the winder, for guiding the camshafts to move up and down, and ratchet portions provided adjacent to the up-and-movement guide and having ratchet projections that engage with the unidirectional projections of the housing; a spiral cam comprising an engaged position portion where the camshafts are positioned when the winder and the spool engage, a disengaged position portion where the camshafts are positioned when the winder and the spool disengage, tension bars for winding the wire by axially rotating the winder and the ratchet, when the spiral cam axially rotates in one direction while the ratchet is interposed between the spiral cam and the winder, and a disengagement portion that disengages the spool and the winder by raising the camshafts when the spiral cam axially rotates in the other direction; and a dial that axially rotates forward and backward by being affixed around the outer periphery of the spiral cam and being affixed to the housing while covering the enclosure, wherein the ratchet comprises winding projections formed on the outer periphery that protrude radially and winding locking protrusions formed on one side of the winding projections, and the tension bars of the spiral cam have an elastic cantilever structure, one end of which is connected to the upper inner periphery of the spiral cam, and the other end of which protrudes to the center of the spiral cam, and comprise winding control projections on the front ends of the tension bars, wherein, when the spiral cam axially rotates, the tension bars, which are resiliently pushed aside to the outer periphery of the spiral camp, slide along the outer side of the winding projections, axially rotate together with the winder and the ratchet while locked against the winding locking protrusions when the winding locking protrusions are reached, and resiliently resume the original state as the winding locking protrusions are climbed over at a predetermined winding position during axial rotation of the spiral cam, and cover and support forward end surfaces of the winding projections of the rachet.

Furthermore, the housing may further comprise a fixing plate formed on the bottom and connected to one side of a shoe to fix the housing.

Furthermore, the disengagement portion may have a sloping structure so that the camshafts move smoothly upward and downward when the camshafts are raised and lowered.

Furthermore, the camshafts may have a sloping structure that slopes at the same angle as the disengagement portion so as to move up and down smoothly along a sloping surface of the disengagement portion.

Furthermore, the ratchet projections of the ratchet portions may protrude outward from the outer side of the ratchet portions, and elastically expand and contract internally and externally when moving along the unidirectional projections, with one end connected to the outer side of the ratchet and the other end having a free-end structure.

Furthermore, the spool may comprise a tunnel formed on one side where the two ends of the wire are placed, and further comprises a wire fixing and releasing means provided at one side of the tunnel to control the fixing and releasing of the wire placed in the tunnel.

DESCRIPTION OF EXEMPLARY EMBODIMENTS

Figure 1:
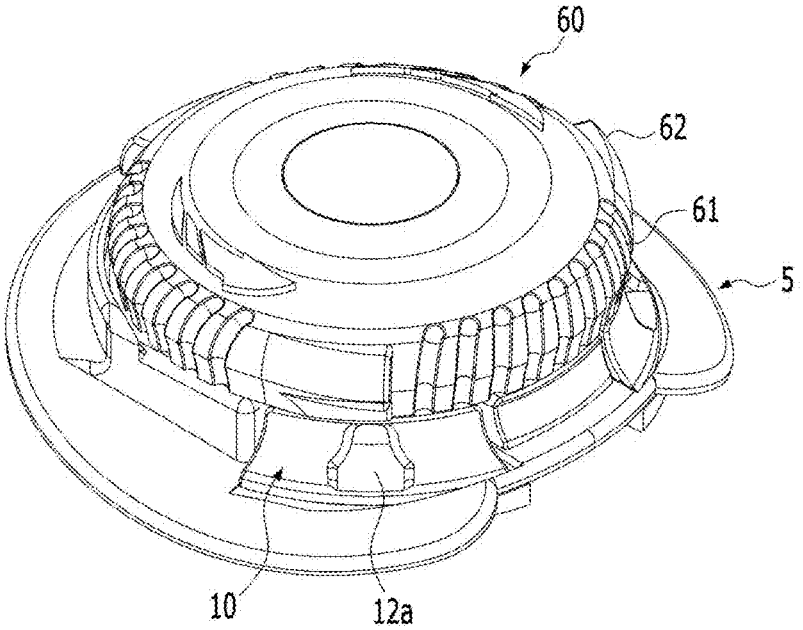
FIG. 1 is a perspective view illustrating an apparatus for tightening wire according to an exemplary embodiment of the present invention.

Hereinafter, the present invention will be described below with reference to the attached drawings.

As shown in FIGS. 1 through 11, an apparatus for tightening wire according to an exemplary embodiment of the present invention comprises a housing 10, a spool 20, a winder 30, a ratchet 40, a spiral cam 50, and a dial 60.

Figure 2:
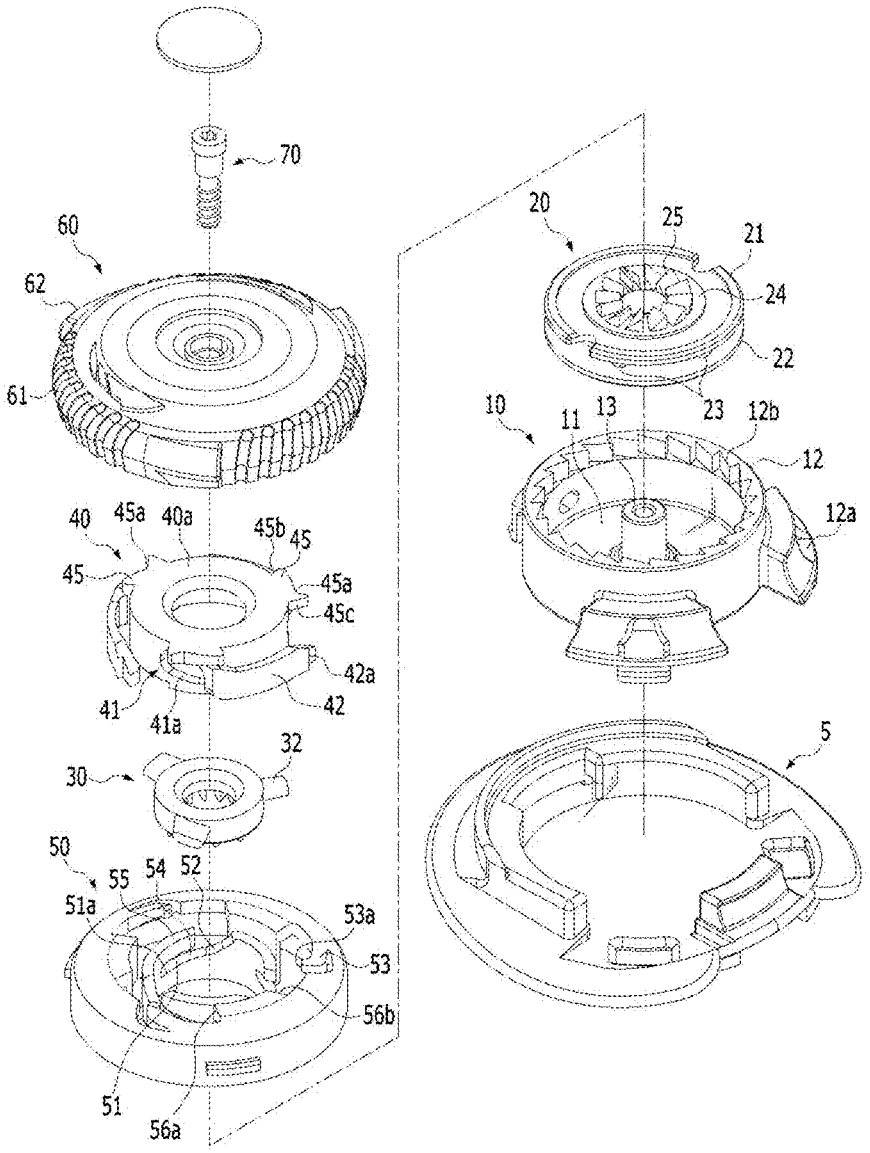
FIG. 2 is an exploded perspective view of the apparatus for tightening wire according to an exemplary embodiment of the present invention, when viewed from above.
Figure 3:
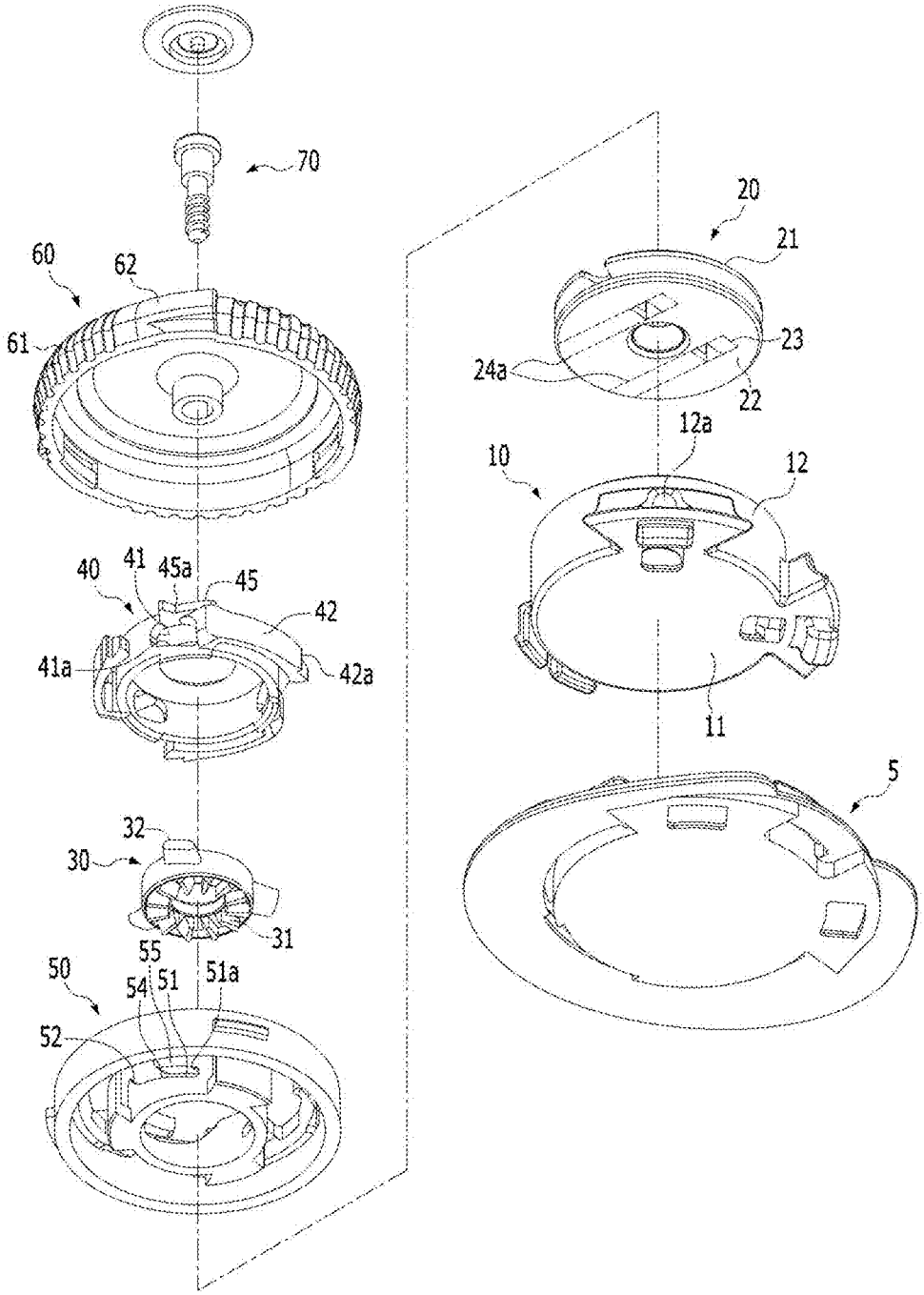
FIG. 3 is an exploded perspective view of the apparatus for tightening wire according to an exemplary embodiment of the present invention, when viewed from below.

Referring to FIGS. 2 and 3, the housing 10 comprises a bottom 11, a pair of gates 12*a* extending upward from the bottom 11 and penetrating the inside and outside of the outer periphery, and a circular tube-like enclosure 12 with unidirectional projections 12*b* formed in succession along the inner periphery.

The housing 10 comprises a fixing plate 5 that extends outward from the lower end of the enclosure 12, for fixing the housing 10 to a target (for example, the upper or side of a shoe) by various methods such as bonding.

Referring to FIGS. 2 and 3, the spool 20 comprises disc-shaped upper and lower plates 21 and 22 fixed to the bottom 11 of the housing 10, down below the unidirectional projections 12*b*, surrounded by the enclosure 12, and vertically separated from each other, communicating holes 23 with a small diameter formed between the upper and lower plates 21 and 22, for communicating with the pair of gates 12*a*, a winding portion 24 to which two ends of a wire 7 guided inside through the communicating holes 23 are fixed, for winding the wire 7 around the outer periphery, and a plurality of winding projections 25 formed in succession in a circular shape on top of the upper plate 21.

Unexplained reference numeral 24*a* denotes a tunnel where the ends of the wire 7 are placed so that the wire 7 introduced through the communicating holes 23 is fixed by a fixation device (not shown).

Referring to FIGS. 2 and 3, the winder 30 is in the shape of a ring, and comprises axial rotating projections 31 placed above the spool 20 to disengage from and engage with the winding projections 25 of the spool 20 when moved up and down vertically, and a plurality of camshafts 32 protruding radially on the edge.

The camshafts 32 have a projection structure that slopes at the same angle as a disengagement portion 54 to be described later so as to slide and move up smoothly when pressed by the axial rotation of the disengagement portion 54.

Also, in a wire releasing mode that works by the engagement and disengagement of the spool 20 and the winder 30, the camshafts 32 are moved to a disengaged position portion 52 along the disengagement portion 54, whereby the top is securely attached to the underside of an upper ratchet plate 40*a* of the ratchet 40, and the bottom is securely attached to the topside of the disengaged position portion 52, thus allowing the camshafts 32 to be firmly interlocked and fixed in place between the upper ratchet plate 40*a* and the disengaged position portion 52.

Referring to FIGS. 2 and 3, the ratchet 40 comes in the shape of a round cap that surrounds the exterior of the winder 30, and comprises an up-and-movement guide 41 with a through-hole structure provided on one side of the outer periphery, for guiding the camshafts 32 to move up and down, and ratchet portions 42 provided adjacent to the up-and-movement guide 41 and having ratchet projections 42*a* that engage the unidirectional projections 12*b* of the housing 10.

Moreover, the up-and-movement guide 41 comprises a sloping surface 41*a* that slopes at the same angle as the camshafts 32 so that the camshafts 32 are firmly attached to it when the camshafts 32 are lowered.

In addition, the ratchet projections 42*a* of the ratchet portions 42 protrude outward from the outer side of the ratchet portions 42, and elastically expand and contract internally and externally when moving along the unidirectional projections 12*b* (in the direction the wire is wound), with one end connected to the outer side of the ratchet 40 and the other end having a free-end structure.

Furthermore, a plurality of winding projections 45 are formed on the outer periphery of the ratchet 40, which are placed at equal intervals and protrude radially. Recessed winding locking protrusions 45*a* are formed on one side of the winding projections 45 so that the ratchet 40 and the winder 30 axially rotate together when the spiral cam 50 axially rotates, while winding control projections 53*a* of tension bars 53 to be described later are locked against them.

Unexplained reference numeral 45*b* denotes axially rearward end surfaces of the winding projections 45, and 45*c* denotes axially forward end surfaces of the winding projections 45.

Referring to FIGS. 2 and 3, the spiral cam 50 comprises an engaged position portion 51 where the camshafts 32 are positioned when the winder 30 and the spool 20 engage, a disengaged position portion 52 where the camshafts 32 are positioned when the winder 30 and the spool 20 disengage, tension bars 53 with winding control projections 53*a* for winding the wire 7 around the spool 20 by axially rotating the winder 30 and the ratchet 40, when the spiral cam 50 axially rotates in one direction while the ratchet 40 is interposed between the spiral cam 50 and the winder 30, and a disengagement portion 54 that disengages the spool 20 and the winder 30 by raising the camshafts 32 when the spiral cam 50 axially rotates in the other direction.

Here, the disengagement portion 54 has a sloping structure so that the camshafts 32 are moved smoothly upward when a lower part of the side of the camshafts 32 is pressed.

Moreover, an anti-lift projection 55 is provided above the engaged position portion 51, to prevent the camshafts 32 positioned in the engaged position portion 51 from being lifted upward during rotation of the dial 60.

In addition, a lock position portion 51*a*, which is the lowermost end of the disengagement portion 54, is provided adjacent to and lower than the engaged position portion 51 so that the camshafts 32 are finally positioned there as their relative position is moved when the spiral cam 50 axially rotates at a predetermined angle.

Unexplained reference numeral 56*a* denotes projecting forward end surfaces that abut the rearward end surfaces of the winding projections 45, and 56*b* denotes projecting rearward end surfaces that abut the forward end surfaces of the winding projections 45.

More specifically, the tension bars 53 have an elastic cantilever structure, one end of which is connected to the upper inner periphery of the spiral cam 50, and the other end of which protrudes with a slope to the center of the spiral cam 50. Thus, when the spiral cam 50 axially rotates, the tension bars 53 slide along the outer side of the winding projections 45 of the ratchet 40 and are then resiliently moved backwards to the inner periphery of the spiral cam 50 while locked against the winding locking protrusions 45*a*. Next, the tension bars 53 resiliently resume the original state as they climb over the winding locking protrusions 45*a* at a final winding position (so-called optimal tension point) of the spiral cam 50, and therefore elastically support the winding projections 45 of the ratchet 40 to fix them in front and back of axial rotation direction.

Also, the winding control projections 53*a* are curved and protrude toward the center of the spiral cam 50 from the front ends of the tension bars 53, and axially rotate the ratchet 40 and the winder 30 as they are locked against the winding locking protrusions 45*a* of the winding projections 45, and at the same time, abut selectively on the front and rear surfaces of the winding projections 45 along the direction of the arc, thereby fixing and supporting the ratchet 40.

Moreover, the winding control projections 53*a* have a curved structure, with their outer peripheries being rounded so that the winding projections 45 climb smoothly over them during axial rotation.

Referring to FIGS. 2 and 3, the dial 60 has a round cap structure in which it axially rotates forward and backward by being affixed around the outer periphery of the spiral cam 50 and being affixed to the housing 10 while covering the enclosure 12.

Moreover, the dial 60 comprises a series of corrugated anti-slip projections 61 formed along the outer periphery to prevent fingers from slipping off while rotating it.

In addition, a plurality of finger locking protrusions 62 are formed at equal intervals in between the anti-slip projections 61 to enable stable rotating operation of the dial 60 as the fingers get locked against them.

Meanwhile, in the wire tightening apparatus of the present invention, a fastener support 13 in the shape of an upright circular tube is formed on the bottom 11 of the housing 10, through-holes are formed at the center of the other corresponding components including the spool 20, camshafts 30, ratchet 40, spiral cam 50, and dial 60, respectively, and a fastener 70 is passed through the through-hole of the dial 60 to fasten and fix all of them to the fastener support 13.

A process of operating the wire tightening apparatus with the above configuration according to the present invention will be described below.

First of all, the spool 20 can be placed by having the fastener support 13 penetrate the bottom 11 of the housing 10, the winder 30 and the ratchet 40 are mounted at the center of the spiral cam 50, and then the dial 60 is placed over the winder 30 and the ratchet 40 to have them embedded in it and affixed to the spiral cam 50.

Next, the dial 60 with the spiral cam 50 connected to it is placed over the exterior of the housing 10, and then the fastener 70 penetrating the entire components is fastened to the fastener support 13, thereby completing the assembling.

Also, a fixing plate 5 is connected to the bottom of the housing 10 in order for it to be attached to a corresponding shoe, and then attached to a desired position of the corresponding shoe so as to wind and unwind the wire by rotating operation.

A process of operating the wire tightening apparatus with the above configuration according to the present invention will be described below.

Figure 4:
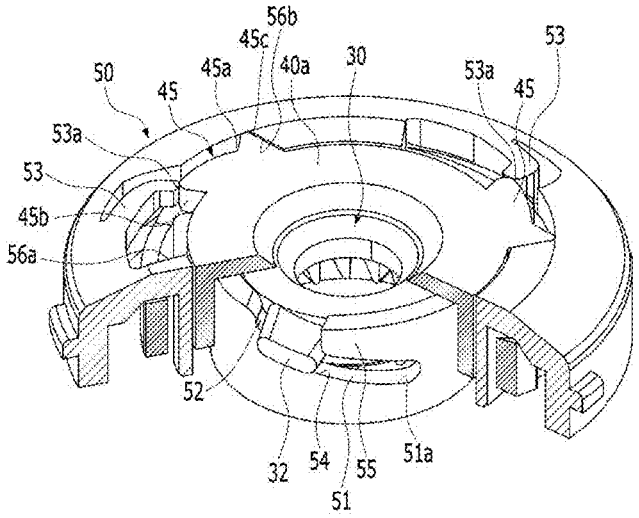
FIG. 4 is a cutaway perspective view of the essential parts of the apparatus for tightening wire according to an exemplary embodiment of the present invention, before the wire is wound up.
Figure 7:
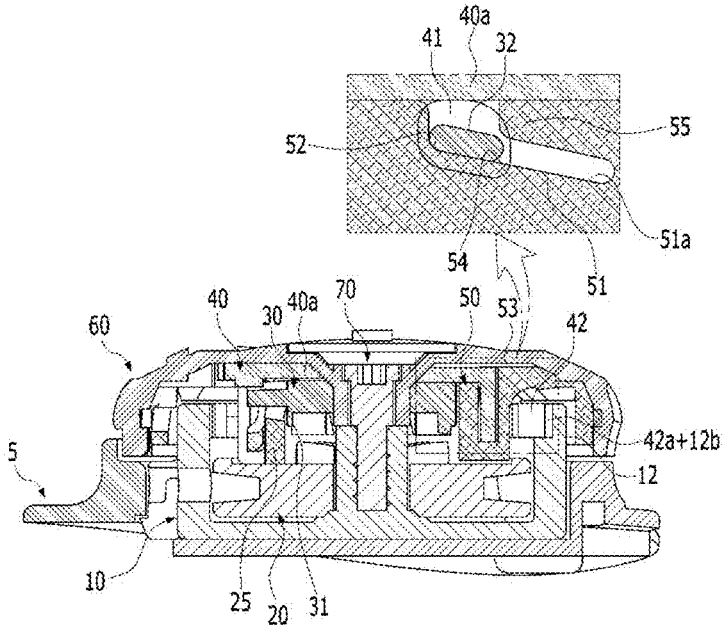
FIG. 7 is a cross-sectional view of the essential parts of the apparatus for tightening wire according to an exemplary embodiment of the present invention, before the wire is wound up.

Referring to FIGS. 4 and 7, the disengaged position portion 52 and the up-and-movement guide 41 are penetrated, and at the same time, their top sides are supported between the upper ratchet plate 40*a* and the disengaged position portion 52 while securely attached to the underside of the upper ratchet plate 40*a* of the ratchet 40. At this point, the winding projections 45 are placed in off position—that is, the rearward end surfaces 45*b* of the winding projections 45 and the winding control projections 53*a* of the tension bars 53 abut each other and the forward end surfaces 45*c* of the winding projections 45 and the projecting rearward end surfaces 56*b* abut each other, thereby allowing the winding projections 45 to be stably fixed in place.

Figure 5:
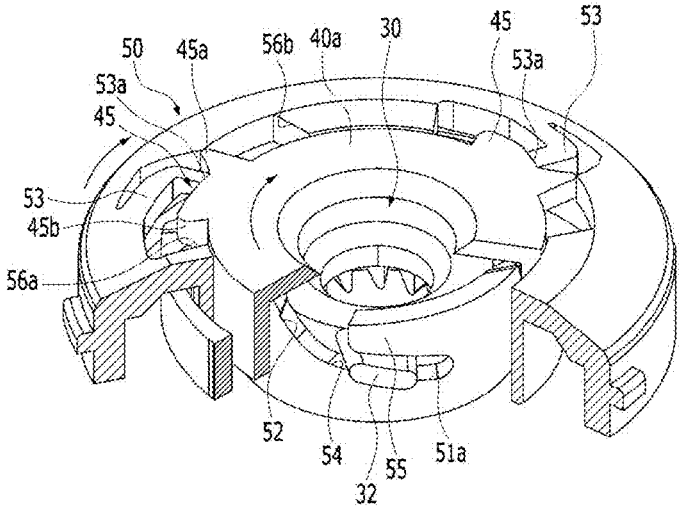
FIG. 5 is a cutaway perspective view of the essential parts of the apparatus for tightening wire according to an exemplary embodiment of the present invention, when the wire is in an optimally tightened state.
Figure 8:
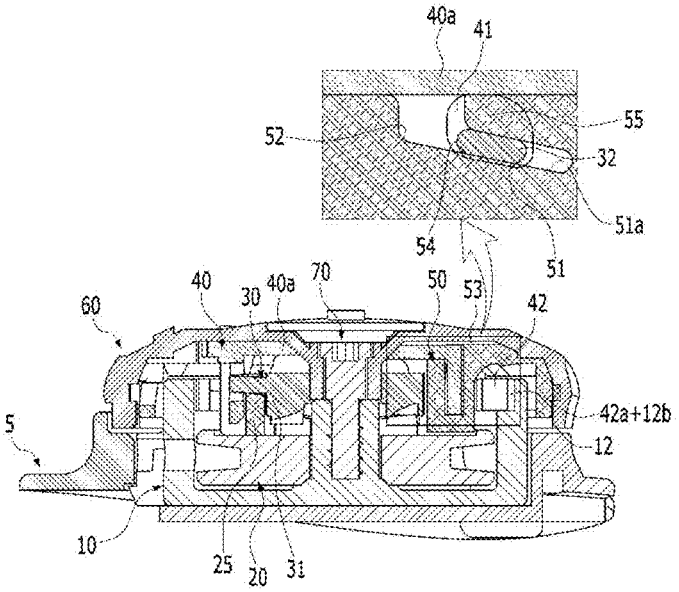
FIG. 8 is a cross-sectional view of the essential parts of the apparatus for tightening wire according to an exemplary embodiment of the present invention, when the wire is in an optimally tightened state.

Furthermore, referring to FIGS. 5 and 8, as for the front ends of the camshafts 32, when the dial 60 is rotated forward (clockwise), the ratchet 40 and the winder 30 (i.e., the camshafts 32) are stopped in their place until the tension bars 53 of the spiral cam 50 reach the winding locking protrusions 45*a* of the ratchet 40. On the other hand, the spiral cam 50 is moved away from the disengaged position portion 52 as it rotates forward (clockwise), and the tension bars 53 of the continuously rotating spiral cam 50 keep moving while abutting the outer sides of the winding projections 45 and then, when they reach the winding locking protrusions 45*a*, the camshafts 32 move down along the disengagement portion 54 and then cause the axial rotating projections 31 to engage with the winding projections 25 of the spool 20 when they reach the engaged position portion 51.

Subsequently, when the dial 60 (spiral cam) is axially rotated, the winding control projections 53*a* axially rotate the ratchet 40 and the winder 30 from this point on (that is, the ratchet 40 axially rotates as the ratchet projections 42*a* of the ratchet 40 resiliently climb over the unidirectional projections 12*b* of the housing 10) while locked against the winding locking protrusions 45*a*. In this case, the camshafts 32 of the winder 30, which are kept in place while engaging with the spool 20 positioned lower than them, axially rotate as well, without being lifted up, while placed in the engaged position portion 51 below the anti-lift projection 55.

Figure 11:
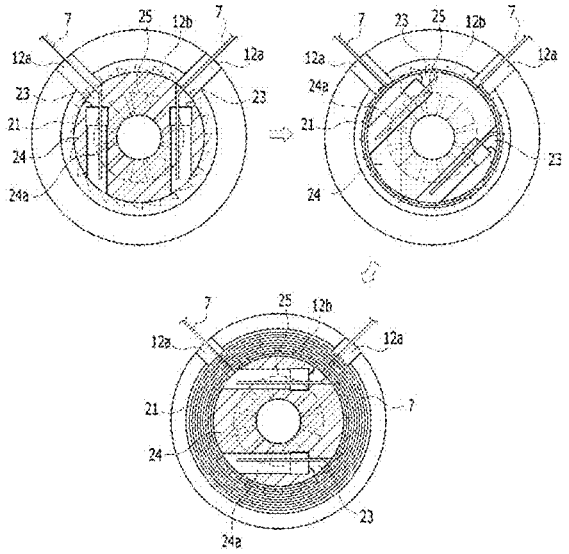
FIG. 11 is a schematic view sequentially illustrating a process in which wire is wound on a spool of the wire tightening apparatus according to an exemplary embodiment of the present invention.

At this point, if the dial 60 continues to be axially rotated, the tension bars 53 axially rotate the ratchet 40, then the ratchet 40 axially rotates the winder 30, and then the winder 30 axially rotates the spool 20, thereby causing the wire 7 to be ultimately wound around the winding portion 24, as shown in FIG. 11.

Figure 6:
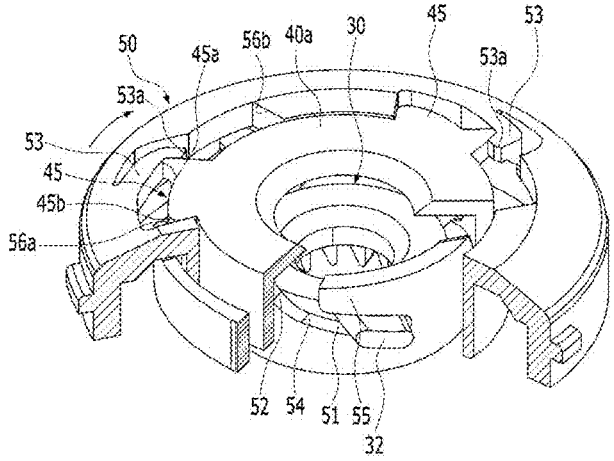
FIG. 6 is a cutaway perspective view of the essential parts of the apparatus for tightening wire according to an exemplary embodiment of the present invention, when the wire has just been optimally tightened.
Figure 9:
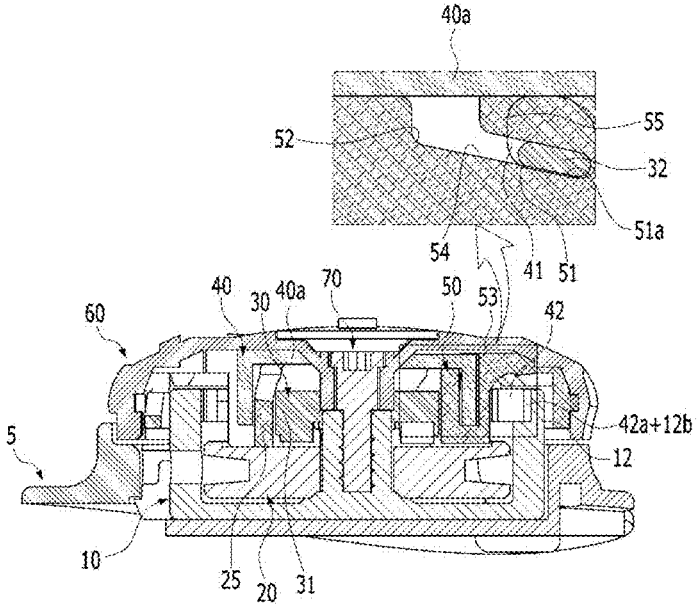
FIG. 9 is a cross-sectional view of the essential parts of the apparatus for tightening wire according to an exemplary embodiment of the present invention, when the wire has just been optimally tightened.
Figure 10:
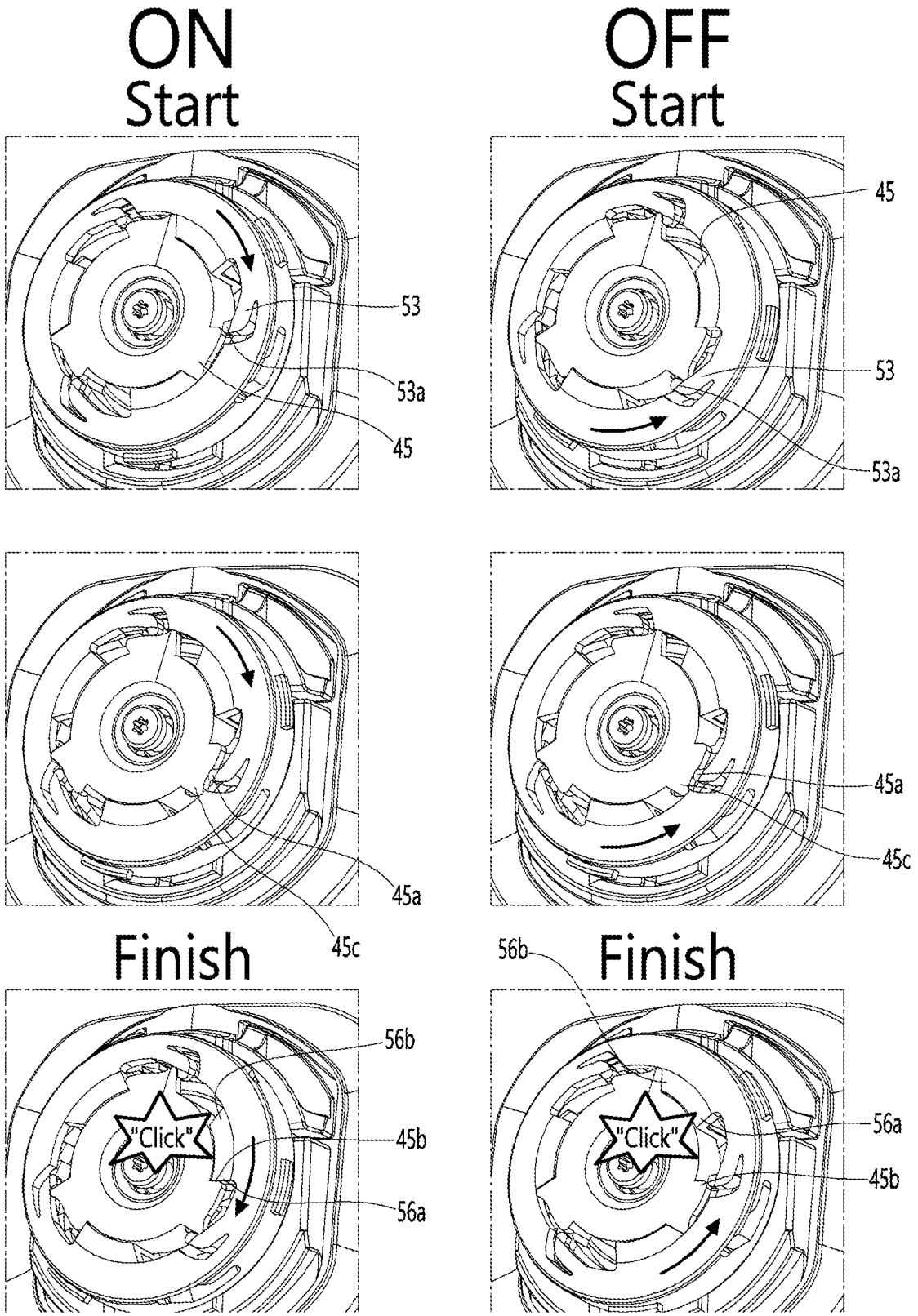
FIG. 10 is a schematic view sequentially illustrating a tightening on-off process for the wire tightening apparatus according to an exemplary embodiment of the present invention.

Furthermore, referring to FIGS. 6 and 9, when the winding of the wire 7 reaches the optimal point of tension, the ratchet 40 and the winder 30 do not axially rotate any longer but stop temporarily due to the winding tensile force of the wire 7, and only the spiral cam 50 axially rotates at a predetermined angle by the continuous axial rotation of the dial 60. While the spiral cam 50 is axially rotating, the tension bars 53 are pushed backward by the outer sides of the winding projections 45 and then resiliently resume their original state when the tension bars 53 climb over the winding projections 45. Thus, the winding projections 45 are placed between the winding control projections 53*a* and the projecting forward end surfaces 56*a* and therefore maintain the optimal state of tension while firmly interlocked and fixed there.

At this point, a hit sound (clicking) may be produced by the winding control projections 53*a* of the tension bars 53 returning to the original state, thus indicating that the optimal point of tension is reached.

Also, as the relative position of the camshafts 32 is moved when the spiral cam 50 axially rotates at a predetermined angle, they are finally positioned in the lock position portion 51*a*, which is the lowermost end of the disengagement portion 54, and at the same time, they are kept from being lifted upward by means of the anti-lift projection 55, thereby allowing the axial rotating projections 31 and the winding projections 25 to firmly engage.

Meanwhile, at this point, if the dial 60 is axially rotated, the tension on the wire 7 goes beyond the optimal state of tension, and from this point on, instead of axially rotating the ratchet 40 and the winder 30 as the projecting forward end surfaces 56*a* push the rearward end surfaces 45*b* of the winding projections 45, the winding of the wire 7 continues, with the doubled force of rotation for axially rotating the dial 60.

On the other hand, in a wire releasing operation (wire releasing mode) which will be described with reference to FIGS. 4 and 6, the winding projections 45 are placed in on position—that is, the forward end surfaces 45*c* of the winding projections 45 and the winding control projections 53*a* of the tension bars 53 abut each other and, at the same time, the rearward end surfaces 45*b* of the winding projections 45 and the projecting forward end surfaces 56*a* abut each other, thus allowing the winding projections 45 to be stably fixed in place. At this point, the front ends of the camshafts 32 placed in the lock position portion 51*a* move up immediately by elastic and repellent force caused by the tensile force of the wire 7 wound on the spool 20 when the dial 60 is rotated backward (counterclockwise), thereby disengaging the winder 30 and the spool 20 from each other.

That is, the ratchet 40 rotates backwards as the tension bars 53 of the spiral cam 50 are disengaged from the winding projections 45, and is then continuously stopped in place (that is, the backward rotation is stopped as the ratchet projections 42*a* of the ratchet 40 is locked against the unidirectional projections 12*b* of the housing 10) after the forward end surfaces 45*c* of the winding projections 45 and the projecting rearward end surfaces 56*b* are placed into a position where they abut each other. At the same time, the camshafts 32 placed in the lock position portion 51*a* by the backward rotation of the spiral cam 50 slide along the disengagement portion 54 having a sloping structure and move to the disengaged position portion 52 located above them, and, as a result, the axial rotating projections 31 and the winding projections 25 located below them are disengaged from each other, and at the same time, the wire 7 instantly becomes released.

Meanwhile, the tension bars 53 are pushed backward by the outer sides of the winding projections 45 while the spiral cam 50 is rotating backward, and the tension bars 53 then resume the original state as the tension bars 53 pass over the winding projections 45, whereby the winding projections 45 are placed between the projecting rearward end surfaces 53*b* and the winding control projections 53*a* and therefore stay firmly interlocked and fixed in place.

This way, the backward rotation of the dial 60 is stopped (that is, the backward rotation is stopped as the ratchet projections 42*a* of the ratchet 40 are locked against the unidirectional projections 12*b*) as the tension bars 53 abut the rearward end surfaces 45*b* of the winding projections 45, whereas the spool 20 can rotate freely and the wire 7 therefore keeps unwinding from the winding portion 24.

As such, the wire 7 can be wound or unwound by the simple forward and backward rotation of the dial 60.

Figure 12:
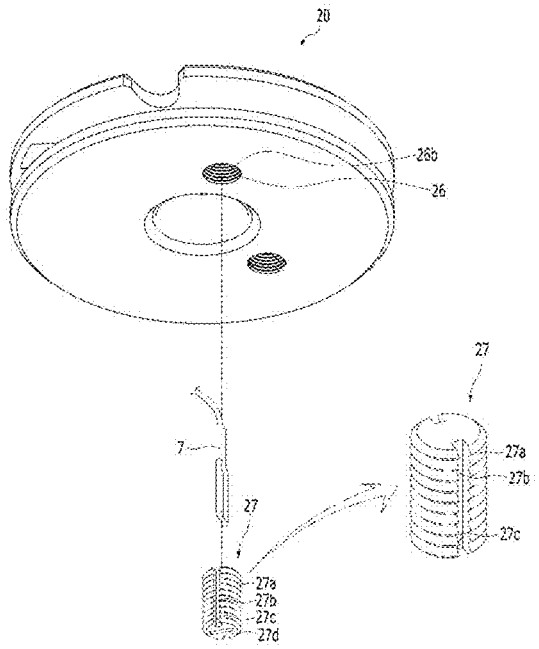
FIG. 12 is an exploded perspective view of the essential parts of the apparatus for tightening wire according to an exemplary embodiment of the present invention, when a wire fixing and releasing means is applied.
Figure 13:
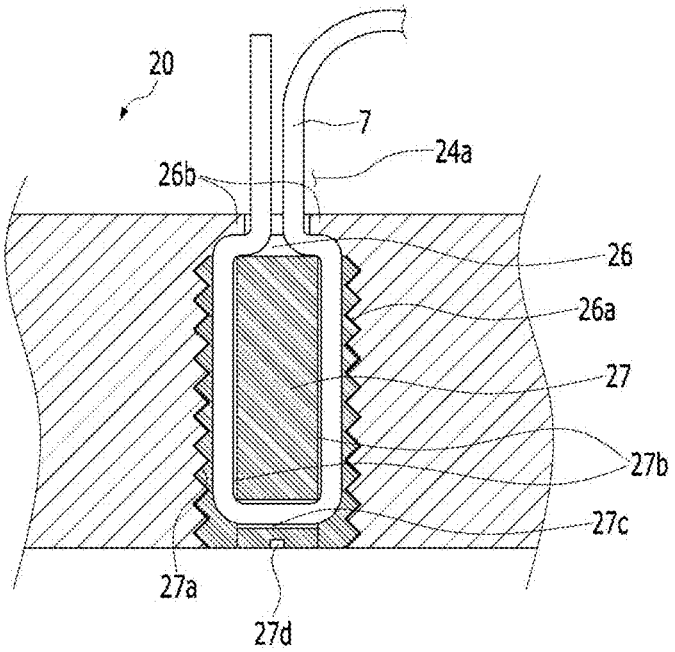
FIG. 13 is a cross-sectional view of the essential parts of the apparatus for tightening wire according to an exemplary embodiment of the present invention, when the wire fixing and releasing means is applied.

Meanwhile, in another exemplary embodiment of the present invention, as shown in FIGS. 12 and 13, a wire fixing and releasing means is provided at one side of the tunnel 24*a* to control the fixing and releasing of the wire 7 fixed to the tunnel 24*a*.

The wire fixing and releasing means comprises, for example, a through-hole 26 punctured through the bottom of the spool 20 at one side of the tunnel 24*a*, and a connector 27 detachably attached to the through-hole 26, that can be mounted and secured in the through-hole 26 while connected to an end of the wire 7 placed in the tunnel 24*a*, or can be disconnected from the wire.

More specifically, the through-hole 26 comprises a thread 26*a* formed on the inner periphery and a pair of ring-shaped locking protrusions 26*b* protruding toward the center axis of the through-hole 26, at the ends adjacent to the tunnel 24*a*.

Moreover, the corresponding connector 27 has a cylindrical structure that comprises a thread 27*a* screwed to the thread 26*a* of the through-hole 26, a wire slot 27*b* on two opposite sides of the outer periphery that extends lengthwise and houses the wire 7 in order to keep the wire 7 from protruding outward from the outer periphery of the connector 27, and a wire pass-through hole 27*c* on one side of the lower end of the wire slot 27*b* that allows the wire 7 to run from one side of the wire slot 27*b* to the other side of the wire slot 27*b*.

In addition, a fastening groove 27*d* is provided on the bottom of the lower end of the connector 27, where the connector 27 fastened to the through-hole 26 is exposed to the bottom of the spool 20, to fasten and unfasten the connector 27 to and from the through-hole 26 by means of a tool (a driver or the like).

The connector 27 works by pulling the wire introduced into the tunnel 24*a* out of the bottom of the spool 20 through the through-hole 26.

Afterwards, the wire 7 is placed at one side of the wire slot 27*b* of the connector 27, and the end of the wire 7 is then passed through the wire pass-through hole 27*c* and pulled out to the other side of the wire slot 27*b*.

Subsequently, the wire 7 pulled out to the other side is placed at the other side of the wire slot 27*b* and then guided towards the upper end of the connector 27 so that the end of the wire 7 has a slight margin, well above the upper end of the connector 27.

Then, the wire 7 may fully cover the upper and lower parts of the connector 27, and, in this state, the connector 27 is screwed to the through-hole 26 of the spool 20.

Once the connector 27 is finally and completely screwed and inserted into the through-hole 26, one side of the end of the wire 7 and the opposite side are pressed between the bottoms of the locking protrusions 26*b* of the through-hole 26 and the top end surface of the connector 27, and the end of the wire 7 therefore protrudes to the tunnel 24*a*. As a result, the end of the wire 7 becomes firmly fixed to the spool 20 through the through-hole 26 and the connector 27.

Meanwhile, if the wire 7 breaks during use or needs to be replaced due to wear, the connector 27 may be removed from the through-hole 26, contrary to what has been described above, and then a new wire 7 may be connected for use.

As seen above, the wire tightening apparatus according to the present invention allows the winding and unwinding of wire by simple forward and backward rotating operation, by comprising: a spool for winding a wire; a winder that engages with or disengages from the spool; a dial for axially rotating the winder; a ratchet for axially rotating the dial in only one direction where the wire is tightened, and an engagement and disengagement structure that allows the spool and the winder to engage or disengage, so that, through the forward and backward rotation using the engagement and disengagement structure, only the wire is wound when the spool and the winder engage and the wire is unwound when the spool and the winder disengage, thereby allowing the winding and unwinding of the wire by simple forward and backward rotating operation. This makes basic winding operation quick and convenient, and allows for ease of use without any difficulty, especially by elderly people or children with weak grip, thereby making the product more competitive and more reliable.

Furthermore, when the wire becomes optimally wound, a hit sound is produced by the winding control projections of the tension bars, allowing the user to know that the wire has been optimally tightened. This, in turn, offers ease of use and reliability and helps prevent excessive foot tightness and a possible foot injury that can result from it.

What is claimed is:

1. An apparatus for tightening wire, the apparatus comprising:

a housing comprising a bottom, a plurality of gates extending upward from the bottom and penetrating the inside and outside of the outer periphery, and an enclosure with unidirectional projections formed along the inner periphery;

a spool comprising upper and lower plates fixed to the bottom of the housing, down below the unidirectional projections, surrounded by the enclosure, and vertically separated from each other, communicating holes with a small diameter formed between the upper and lower plates, for communicating with the plurality of gates, a winding portion to which two ends of a wire guided inside through the communicating holes are fixed, for winding the wire around the outer periphery, and a plurality of winding projections formed on top of the upper plate;

a winder comprising axial rotating projections placed above the spool, for disengaging from and engaging with the winding projections of the spool when moved up and down, and a plurality of camshafts protruding radially on the edge;

a ratchet comprising an up-and-movement guide provided on one side of the outer periphery surrounding the exterior of the winder, for guiding the camshafts to move up and down, and ratchet portions provided adjacent to the up-and-movement guide and having ratchet projections that engage with the unidirectional projections of the housing;

a spiral cam comprising an engaged position portion where the camshafts are positioned when the winder and the spool engage, a disengaged position portion where the camshafts are positioned when the winder and the spool disengage, tension bars for winding the wire by axially rotating the winder and the ratchet, when the spiral cam axially rotates in one direction while the ratchet is interposed between the spiral cam and the winder, and a disengagement portion that disengages the spool and the winder by raising the camshafts when the spiral cam axially rotates in the other direction; and a dial that axially rotates forward and backward by being affixed around the outer periphery of the spiral cam and being affixed to the housing while covering the enclosure, wherein the ratchet comprises winding projections formed on the outer periphery that protrude radially and winding locking protrusions formed on one side of the winding projections, and the tension bars of the spiral cam have an elastic cantilever structure, one end of which is connected to the upper inner periphery of the spiral cam, and the other end of which protrudes to the center of the spiral cam, and comprise winding control projections on the front ends of the tension bars, wherein, when the spiral cam axially rotates, the tension bars, which are resiliently pushed aside to the outer periphery of the spiral cam, slide along the outer side of the winding projections, axially rotate together with the winder and the ratchet while locked against the winding locking protrusions when the winding locking protrusions are reached, and resiliently resume the original state as the winding locking protrusions are climbed over at a predetermined winding position during axial rotation of the spiral cam, and cover and support forward end surfaces of the winding projections of the rachet.

2. The apparatus of claim 1, wherein the housing further comprises a fixing plate formed on the bottom and connected to one side of a shoe to fix the housing.

3. The apparatus of claim 1, wherein the disengagement portion has a sloping structure so that the camshafts move smoothly upward and downward when the camshafts are raised and lowered.

4. The apparatus of claim 3, wherein the camshafts have a sloping structure that slopes at the same angle as the disengagement portion so as to move up and down smoothly along a sloping surface of the disengagement portion.

5. The apparatus of claim 1, wherein the ratchet projections of the ratchet portions protrude outward from the outer side of the ratchet portions, and elastically expand and contract internally and externally when moving along the unidirectional projections, with one end connected to the outer side of the ratchet and the other end having a free-end structure.

6. The apparatus of claim 1, wherein the spool comprises a tunnel formed on one side where the two ends of the wire are placed, and further comprises a wire fixing and releasing means provided at one side of the tunnel to control the fixing and releasing of the wire placed in the tunnel.

* * * * *